US005485643A

United States Patent [19]

Beenfeldt et al.

[11] Patent Number: 5,485,643

[45] Date of Patent: Jan. 23, 1996

[54] APPARATUS AND PROCESS FOR TRIMMING A SOLE OF A SHOE

[75] Inventors: Eric Beenfeldt, Orono; Richard O. Eason, Bangor, both of Me.

[73] Assignee: Dexter Shoe Company, Dexter, Me.

[21] Appl. No.: 284,009

[22] Filed: Aug. 1, 1994

[51] Int. Cl.[6] ..... A43D 8/32; A43D 21/00; A43D 93/00; A43D 8/00

[52] U.S. Cl. ..... 12/85; 12/86.7; 12/85.1

[58] Field of Search ..... 12/85, 85.1, 89, 12/93, 86, 86.65, 86.7

[56] References Cited

U.S. PATENT DOCUMENTS

| | | | |
|---|---|---|---|
| 2,561,356 | 7/1951 | Gadd | 12/85.1 |
| 3,076,211 | 2/1963 | Cleversey | 12/85 X |
| 3,397,415 | 8/1968 | Keller | 12/86.65 |
| 3,426,376 | 2/1969 | Clark | 12/86.7 |
| 4,010,502 | 3/1977 | Cushing et al. | 12/86.7 X |
| 4,131,965 | 1/1979 | von den Benken et al. | 12/86.7 |
| 4,416,031 | 11/1983 | Shutt et al. | 12/127 |
| 4,550,462 | 11/1985 | Phillips | 12/17 R |
| 4,663,792 | 5/1987 | Wilkerson | 12/86.5 |
| 4,996,012 | 2/1991 | Gierschewski et al. | 12/1 R X |

*Primary Examiner*—Paul T. Sewell
*Assistant Examiner*—BethAnne C. Cicconi
*Attorney, Agent, or Firm*—Salter & Michaelson

[57] ABSTRACT

An apparatus for trimming a sole of a shoe includes a support structure and a shoe carriage mounted on the support structure. The shoe carriage is constructed and arranged for mounting a shoe thereon and is movable along x and z axes. A sensing station is mounted on the support structure, the sensing station having a detector for detecting the exact outline of the shoe upper with respect to the sole. A cutting station is mounted on the support structure for trimming the sole of the shoe with a first cutter. The first cutter is movable along a y axis and rotatable about a t axis. A microprocessor controls the movement of the carriage between a starting position, the sensing station, the cutting station and back to the starting position and controls the operation and movement of the first cutter for trimming the sole of the shoe when the shoe is in the cutting station. A process for trimming a sole of a shoe is also disclosed.

32 Claims, 16 Drawing Sheets

APPARATUS AND PROCESS FOR TRIMMING A SOLE OF A SHOE

BACKGROUND AND SUMMARY OF THE INVENTION

This invention relates generally to apparatus and processes for trimming shoe soles, and more particularly to a fully automated apparatus and process for trimming shoe soles.

Prior to the present invention, leather shoe soles were typically trimmed by hand on a machine having a number of high-speed rotatable cutters. One roughening cutter was provided to remove excess leather from the sole while another finer cutter trimmed a rubber heel of the shoe to its final configuration. In many applications, a third cutter was provided for bevelling upper and lower edges of the leather sole. This trimming procedure required many skilled workers in order to maintain production for each assembly line for producing shoes.

The foregoing leather sole trimming procedure has the disadvantage of requiring workers to perform the dangerous task of manipulating the shoe close to the high speed cutter (rotating at approximately 10,000 RPM). It also has the disadvantage of requiring the worker to consistently perform the repetitive motions of trimming the outline of the sole with precision for producing high quality shoes. Often, soles of shoes having the same style and size varied from shoe to shoe.

There is presently a need for an apparatus for trimming a leather sole of a shoe which reduces the exposure of workers to the dangerous cutters and which produces shoes having consistently trimmed soles.

Accordingly, among the several objects of the present invention are the provision of an apparatus for trimming a sole of a shoe which trims the leather sole to a near perfect outline for the particular size of shoe; the provision of such an apparatus which substantially eliminates the dangerous task of manually trimming the sole of the shoe with high-speed cutters; the provision of such an apparatus which machines high quality leather soles in a time-efficient manner; the provision of such an apparatus which will save approximately six workers per assembly line; and the provision of such an apparatus which is easy to operate and cost-efficient to use.

It is further an object of the present invention to provide a method of trimming a sole of a shoe which performs a roughening cut, a finer trimming cut and a bevelling cut all in one station in a time saving manner.

In general, an apparatus for trimming a sole of a shoe having a shoe upper with the sole being attached to the shoe upper comprises a support structure and a shoe carriage mounted on the support structure. The shoe carriage is constructed and arranged for mounting a shoe thereon and is movable along x and z axes. A sensing station is mounted on the support structure, the sensing station comprising means for detecting the exact outline of the shoe upper with respect to the sole. A cutting station is mounted on the support structure for trimming the sole of the shoe with a first cutter movable along a y axis. Means controls the movement of the carriage between a starting position, the sensing station, the cutting station and back to the starting position and controls the operation and movement of the first cutter for trimming the sole of the shoe when the shoe is in the cutting station.

A process for trimming a sole of a shoe having a shoe upper with the sole being attached to the shoe upper comprises the steps of: (a) mounting a shoe on a shoe carriage of an apparatus having at least three directions of movement along an x axis, a y axis and a z axis, the shoe carriage being in a starting position and movable along the x and z axes; (b) moving the shoe carriage along the x axis to a sensing station; (c) detecting the exact outline of the shoe upper with respect to the sole; (d) determining a sole trimming pattern based on the outline of the shoe upper with respect to the sole as detected by the sensing station; (e) moving the shoe carriage along the x axis to a cutting station for trimming the sole of the shoe with a first cutter along the sole trimming pattern, the first cutter being movable along the y axis and the shoe carriage being movable along the x and z axes for trimming the sole of the shoe; and (f) moving the shoe carriage back to its starting position.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
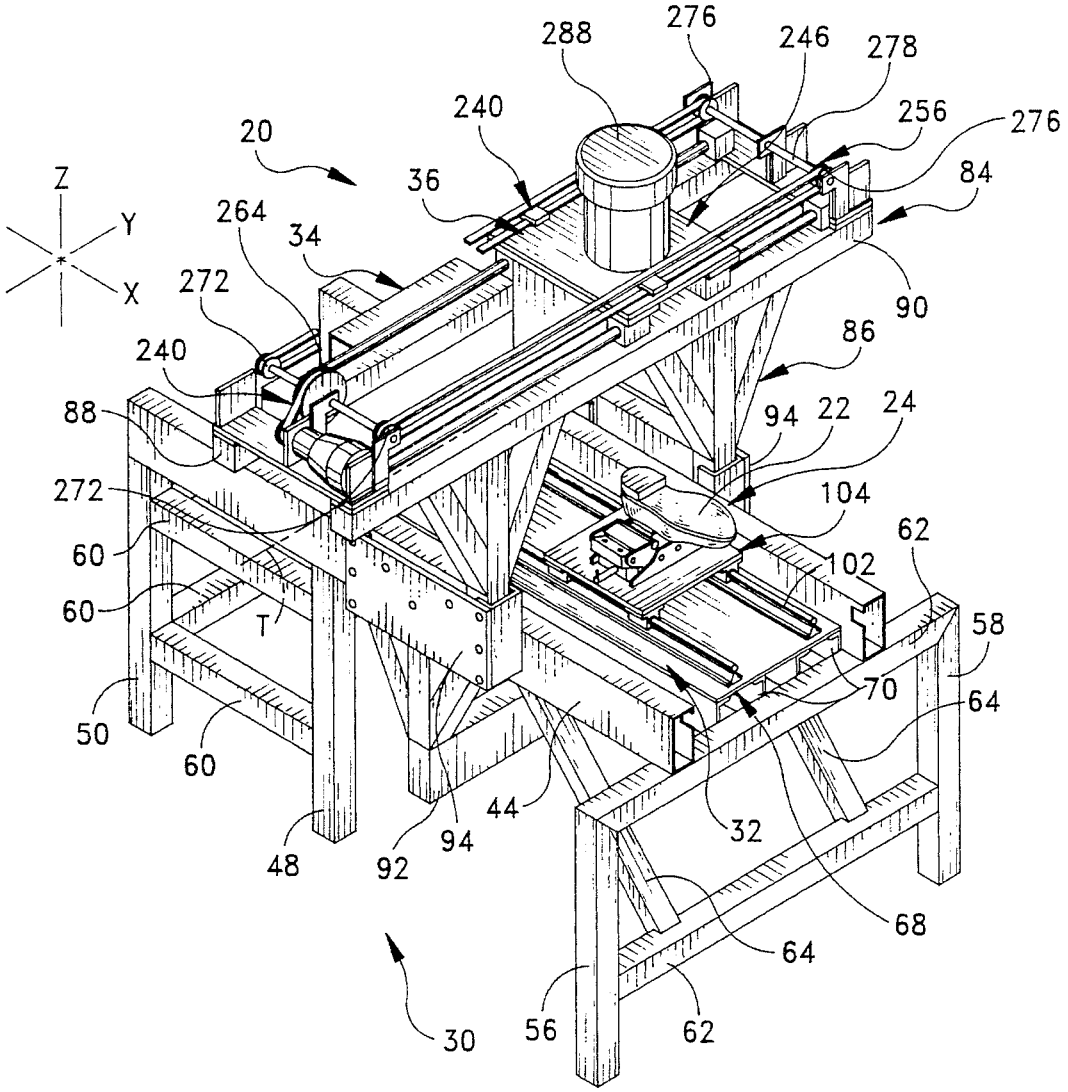
FIG. 1 is a perspective view of an apparatus of the present invention for trimming a sole of shoe.

Referring now to the drawings, and more particularly FIG. 1, there is generally indicated at 20 an apparatus for trimming a sole 22 of a shoe generally indicated at 24. As illustrated throughout the drawings, the shoe 24 includes a shoe upper 26 with the sole 22 of the shoe 24 being attached, as by stitching, to the shoe upper 26. The sole 22 may formed from a blank of leather material (or any other appropriate material) and is oversized to ensure that it completely receives the base of the shoe upper 26 thereon. The shoe 24 also includes a heel 28 (fabricated from rubber) which is mounted on the back end portion of the sole 22 in a suitable manner. The apparatus 20 is specifically designed for automatically trimming the oversized shoe sole and is utilized to adapt the sole to varying shoe styles and sizes and is not limited to one particular style or size of shoe.

Figure 14:
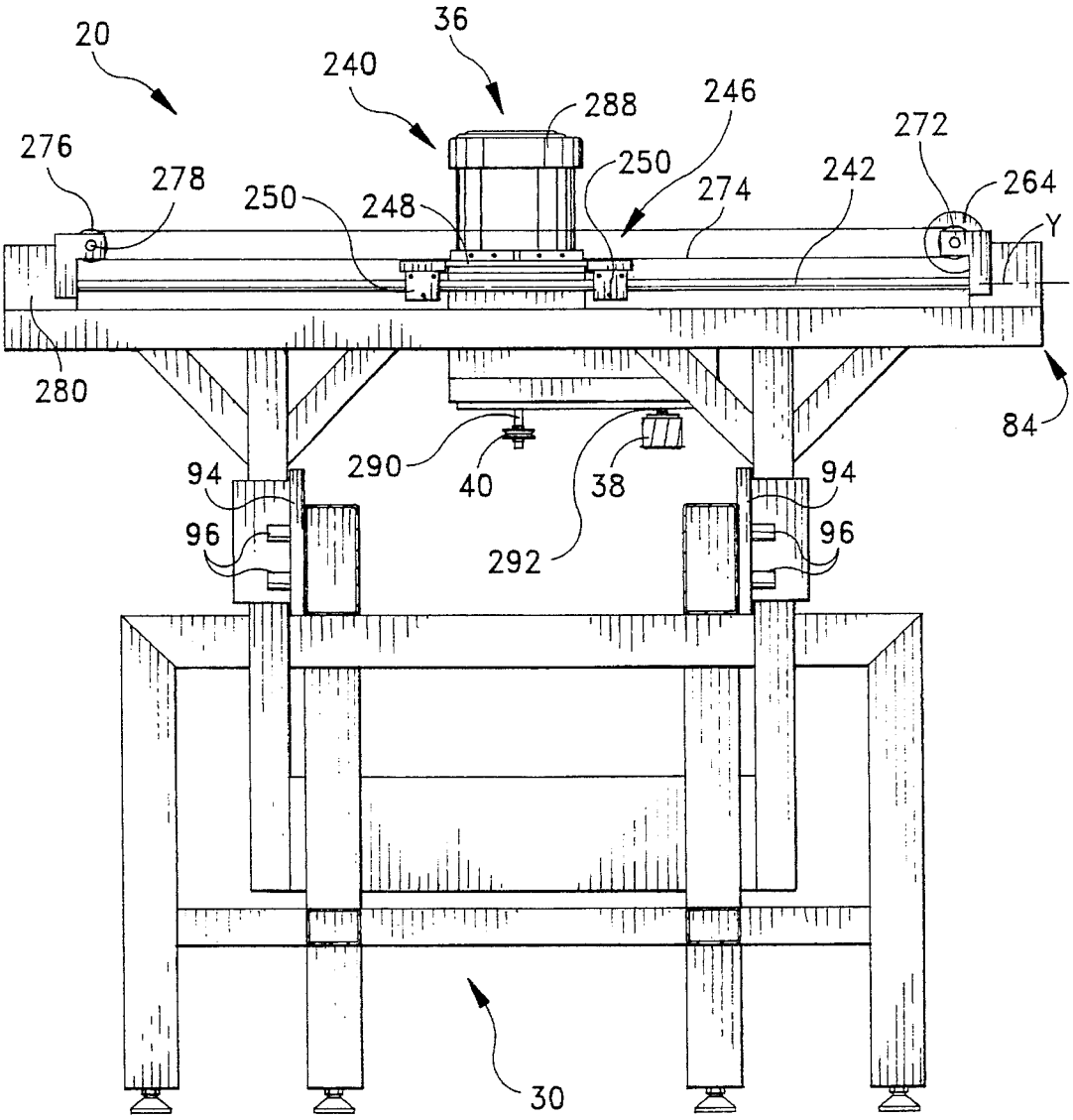
FIG. 14 is a partial end elevation view of the apparatus.

As illustrated in FIG. 1, the apparatus 20 comprises a support structure, generally indicated at 30, a shoe carriage, generally indicated at 32, mounted on the support structure, a sensing station, generally indicated at 34, mounted on the support structure, and a cutting station, generally indicated at 36. The shoe carriage 32 is constructed and arranged for supporting the shoe 24 in a position such that the sole 22 of the shoe 24 faces upwardly. The cutting station 36 is mounted on the support structure 30 and is provided for trimming the sole 22 of the shoe 24 with first and second cutters 38, 40 (FIG. 14). The apparatus 20 has four directions of movement for moving the shoe 24 to be trimmed along an x axis and a z axis, and for moving the first and second cutters 38, 40 along a y axis and rotating the cutters about a t axis. A microprocessor, generally indicated at 42 in FIG. 17, controls the movement of the shoe carriage 32 and the first and second cutters 38, 40 for trimming the sole 22 of the shoe 24 when the shoe is in the cutting station 36. In the preferred embodiment, the microprocessor 42 is a "486" microprocessor which is manufactured by INTEL Corporation of California.

Figure 2:
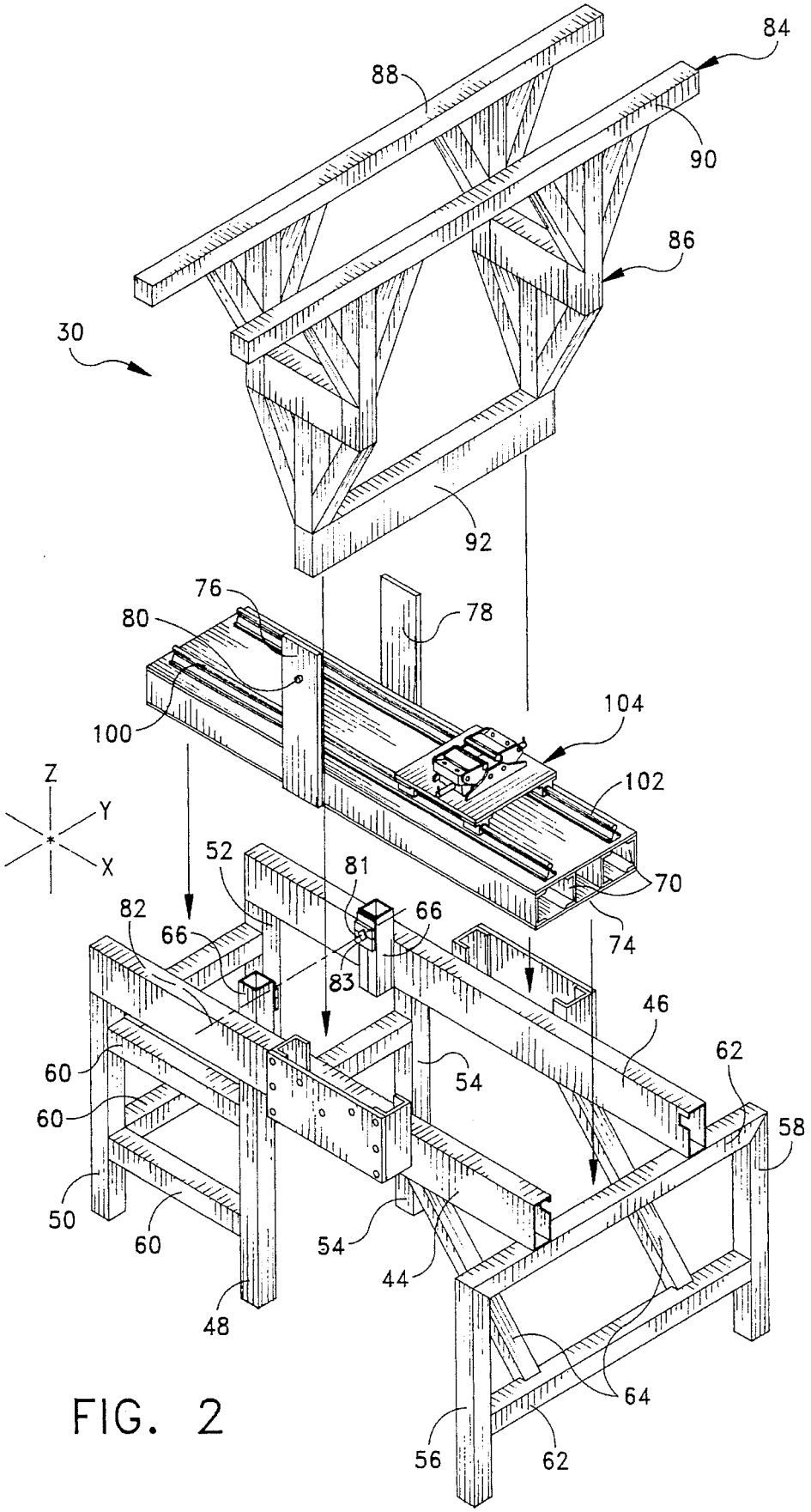
FIG. 2 is an exploded perspective view of a support structure of the apparatus.

Referring now to FIG. 2, the support structure 30 includes two horizontally disposed beams 44, 46 which are supported by six legs 48, 50, 52, 54, 56 and 58. Preferably, the beams 44, 46 and legs 48, 50, 52, 54, 56 and 58 are fabricated from tubular metal material, such as steel, for ensuring that the apparatus 20 is maintained in a stabilized condition. Members, each designated 60, connect legs 48, 50, 52 and 54 together and members, each designated 62, connect legs 56, 58 together. Angle bars, each designated 64, stabilize legs 56, 58 with respect to beams 44, 46. The arrangement is such that beams 44, 46 rest upon the top of legs 48, 50, 52 and 54 and upon member 62. Two vertically extending, tubular extensions, each designated 66, are mounted, as by welding, on respective inner surfaces of beams 44, 46 for pivotally supporting a shoe carriage frame, generally indicated at 68, which houses the shoe carriage 32.

Figure 7:
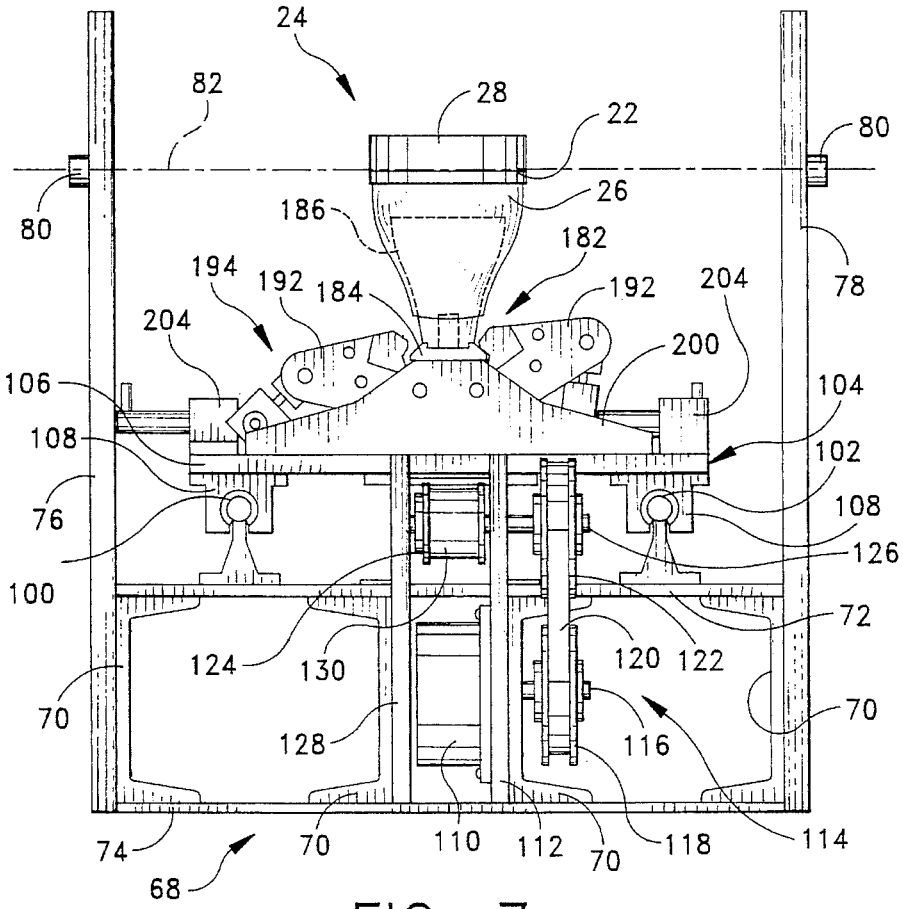
FIG. 7 is a cross section taken along line 7—7 of FIG. 6.
Figure 8:
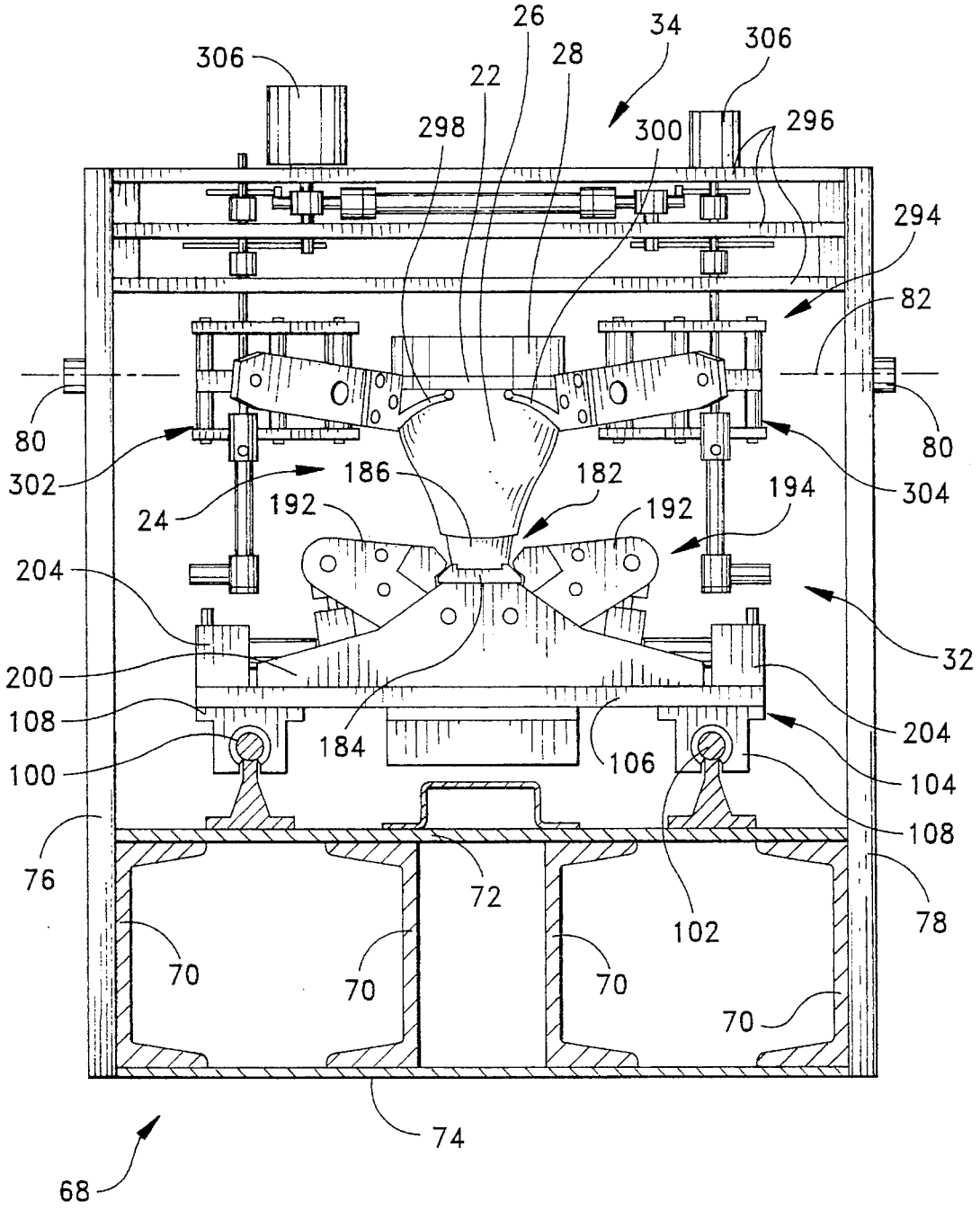
FIG. 8 is a cross section taken along line 8—8 of FIG. 6.

Referring to FIGS. 2, 7 and 8, the shoe carriage frame 68 comprises four longitudinal beams, each indicated 70, which extend in a direction parallel to the x axis, the four beams 70 being sandwiched between two rectangular plates 72, 74. Preferably, the plates 72, 74 are bolted to beams 70. The two outer beams 70 extend the entire length of the frame 68 while the two inner beams 70 support a drive mechanism which will be discussed in detail below. A pair of side plate members 76, 78, one for each side of the shoe carriage frame 68, extend upwardly from the flat surfaces of respective outer beams 70. Each side plate member 76, 78 has an outwardly protruding pin or dowel 80 having a roller bearing (not shown) which as shown in FIG. 2 is received in a corresponding opening 81 formed in a plate 83 on its respective tubular extension 66 of the support structure 30 for supporting the shoe carriage frame 68. The shoe carriage frame 68 is thus adapted to rotate about an axis 82 which extends through the pins 80.

Figure 11:
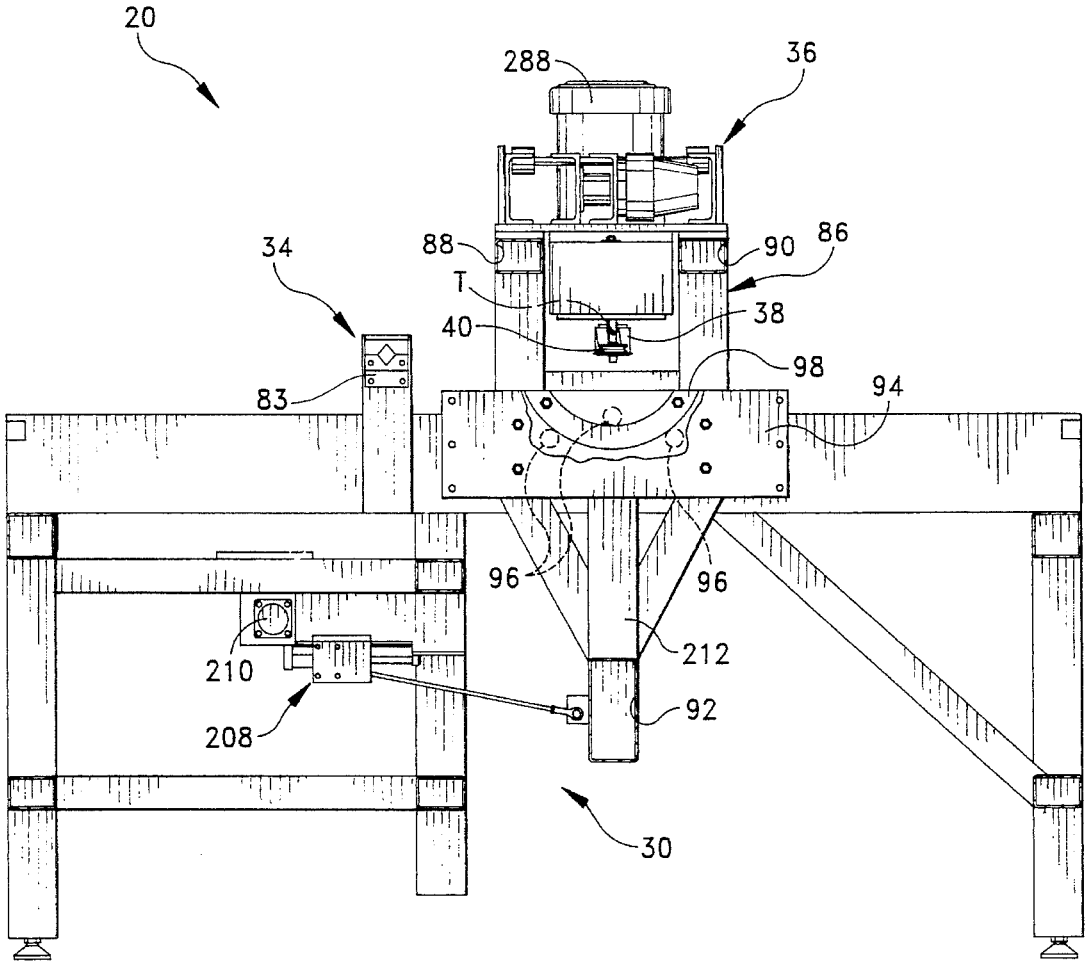
FIG. 11 is a partial side elevation view illustrating a cutting station of the apparatus.
Figure 12:
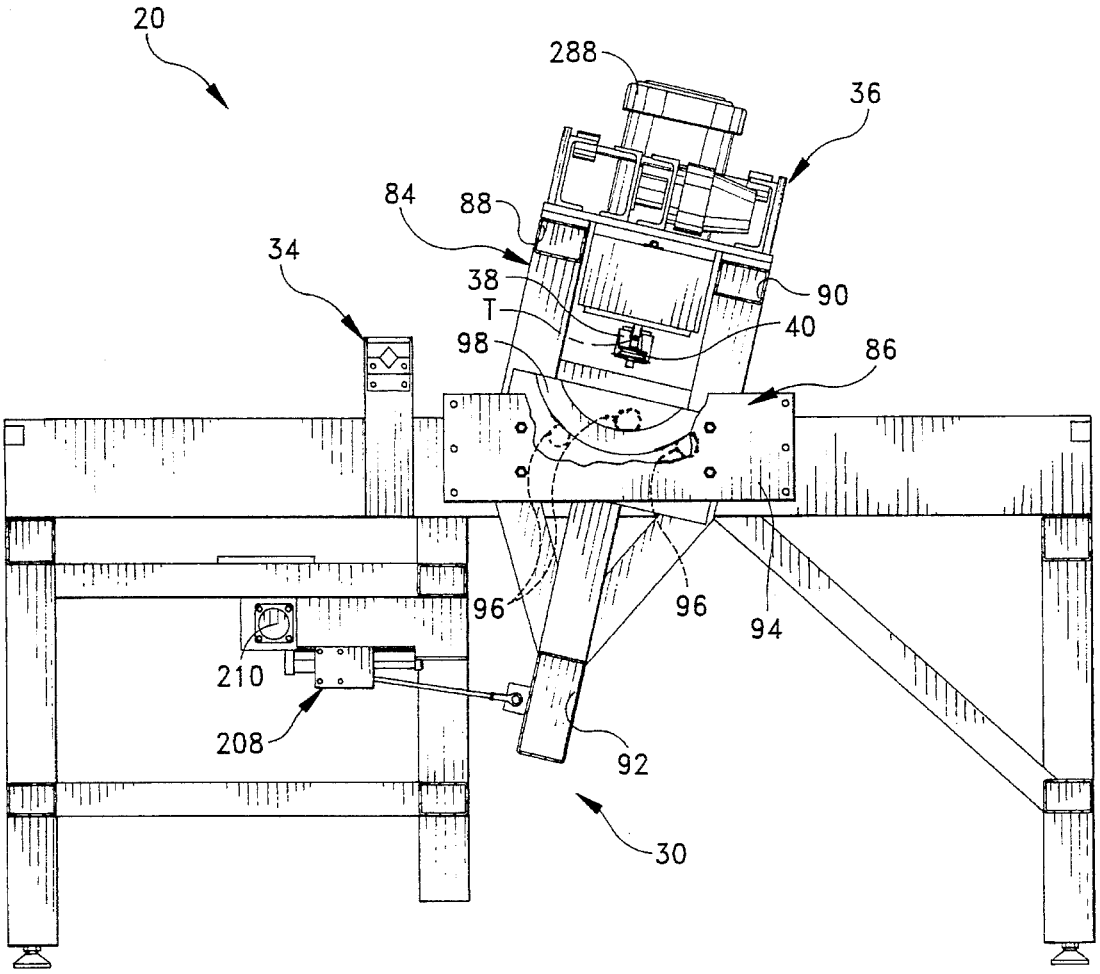
FIG. 12 is a view similar to FIG. 11 illustrating the cutting station being rotated about a t axis.

Referring now to FIGS. 2 and 11, a cutter carriage frame, generally indicated at 84, is pivotally connected to the outer surfaces of beams 44, 46 of the support structure 30. More particularly, the cutter carriage frame includes a pair of spaced apart, yoke frame members, each generally indicated at 86, which are pivotally mounted on the outer surfaces of the beams 44, 46, and a pair of upper cross members 88, 90 and a lower cross member 92 which connect the yoke frame members 86 together. A pair of plates, each indicated 94, are mounted on the outer surfaces of the beams 44, 46 by bolts. Each plate includes three inwardly projecting dowels 96 having rollers at respective ends thereof which are adapted to engage edges of a curved member 98 mounted on the outer surface of the yoke frame member 86. As illustrated in FIGS. 11 and 12, two dowels 96 engage the bottom edge of the curved member 98 and one dowel 96 engages the top edge of the curved member 98 for securing the cutter carriage frame 84 to the support structure 30. This arrangement enables the cutter carriage frame 84 to rotate about the t axis as illustrated in the drawings.

Figure 3:
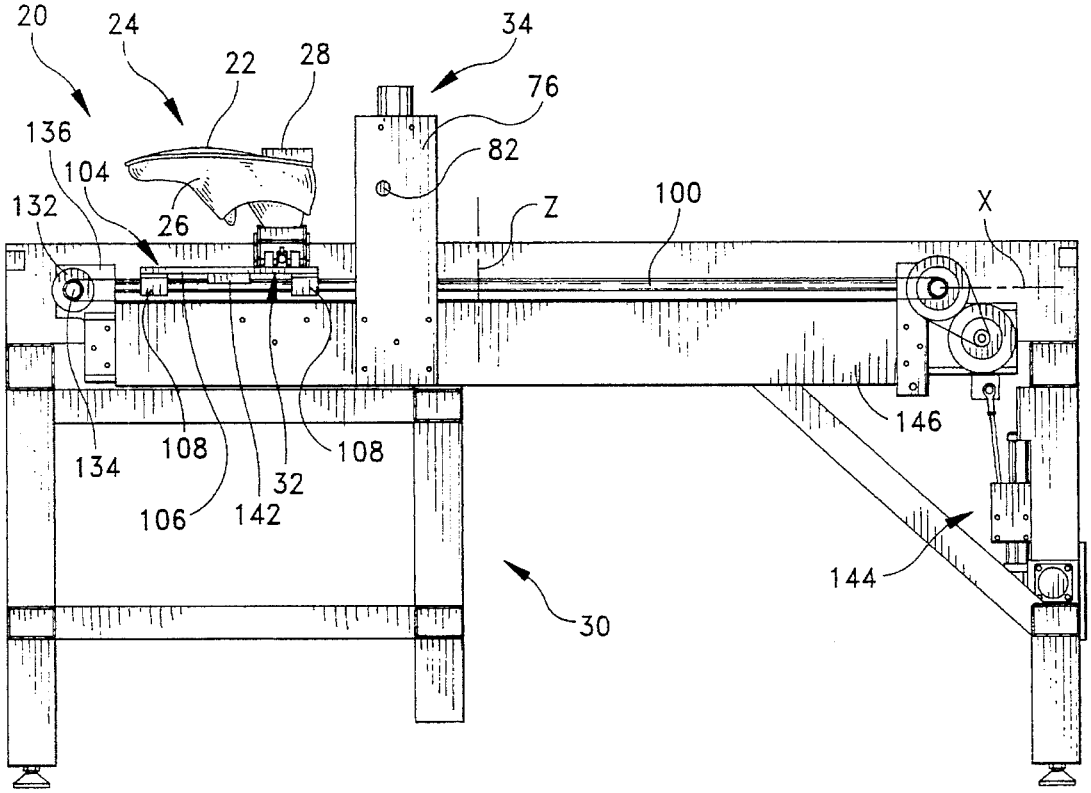
FIG. 3 is a partial side elevation view of the apparatus.
Figure 4:
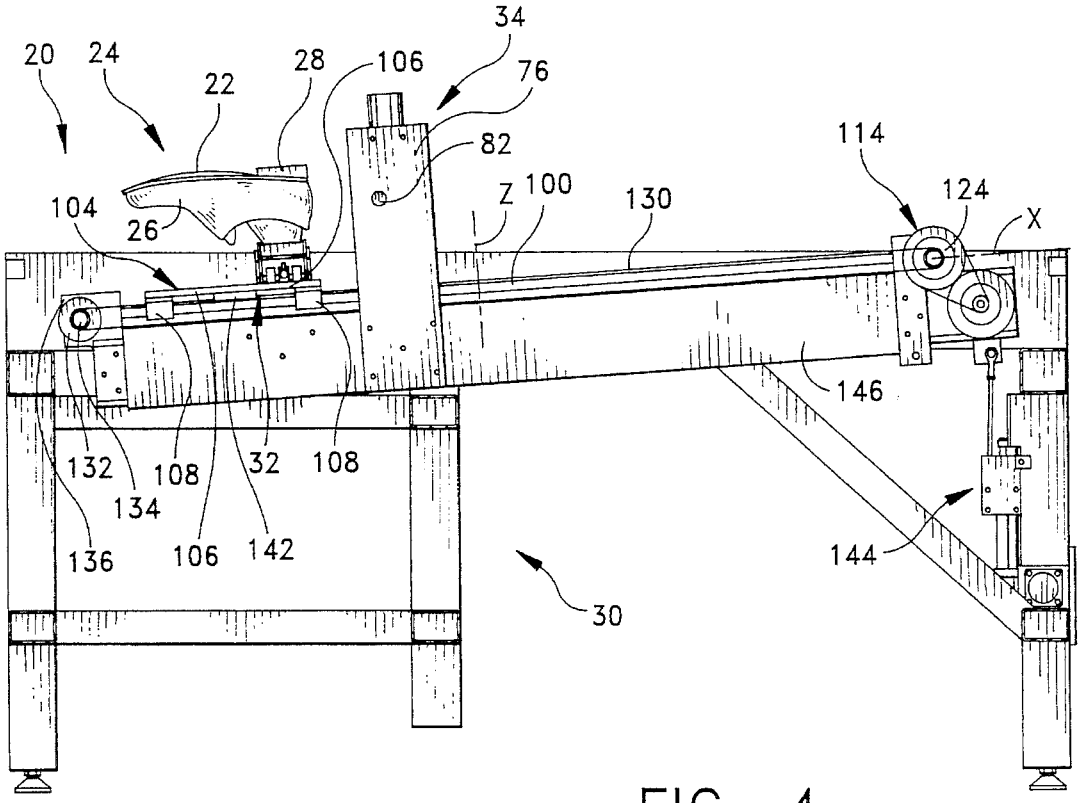
FIG. 4 is a partial side elevation view similar to FIG. 3 with a shoe carriage of the apparatus being illustrated in a lowered position.

Turning now to FIGS. 3, 4 and 8, the shoe carriage 32 comprises a pair of rails 100, 102, each having a circular cross section, and a platform generally indicated at 104 which rides on the rails 100, 102. The rails 100, 102 are mounted (as by bolts) on the top surface of the plate 72 of the shoe carriage frame 68. The platform 104 includes a flat, rectangular plate 106 having four mounting blocks, each indicated at 108, and housing pillow blocks (not shown) therein which ride on the rails 100, 102 for guiding the back and forth movement of the platform 104 along the rails along the x axis. As shown, the mounting blocks 108 are located at the four corners of the plate 106 and are bolted to the plate.

Powering the back and forth movement of the platform 104 along the rails 100, 102 (otherwise sometimes referred to as the "x axis drive") is a servomotor 110 mounted on a vertical support 112 of the shoe carriage frame 68 (see FIG. 7), the servomotor 110 driving a pulley arrangement, generally indicated at 114. The servomotor 110 is preferably an electric motor and, as illustrated in FIG. 7, it rotates a shaft 116 having a first pulley 118 mounted thereon. The first pulley 118 drives a belt 120 which is looped around a second pulley 122 mounted above the first pulley 118 on the vertical support 112. The second pulley 122 in turn drives a third pulley 124 which is mounted on a common shaft 126 which extends between the vertical support 112 and another vertical support 128 by suitable bearings (not shown). As shown in FIG. 4, the third pulley 124 drives a belt 130 which extends along the length of the shoe carriage frame 68 and is looped around a fourth pulley 132 rotatable about a shaft 134 supported by a mounting block 136 located at the far end of the frame 68.

Figure 4A:
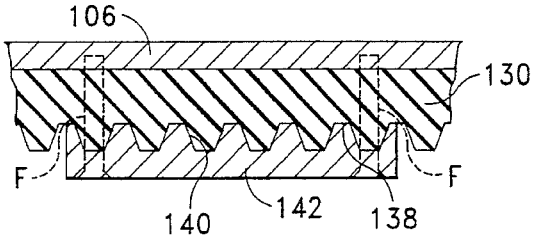
FIG. 4A is an enlarged cross-sectional detail view of an x axis drive of the apparatus.

Referring to FIG. 4A, the belt 130 has grooves 138 formed therein which engage teeth (not shown) formed in the third and fourth pulleys 124, 132. The grooves 138 of the belt 130 also engage teeth 140 formed in a bracket 142 mounted on the underside of the plate 106 of the platform 104 which captures the belt 130 between the bracket 142 and the plate 106. Suitable fasteners F secure the bracket 142 to, the plate 106. The bracket teeth 140 are formed on the surface of the bracket 142 facing the grooves 138 of the belt 130 for mating therewith and for enabling the platform 104 to move longitudinally along the rails 100, 102 as the belt 130 moves. Thus, by rotating the shaft 116 of the servomotor 110 clockwise or counterclockwise, the back and forth movement of the platform 104 along the rails 102, 104 is controlled.

Figure 5:
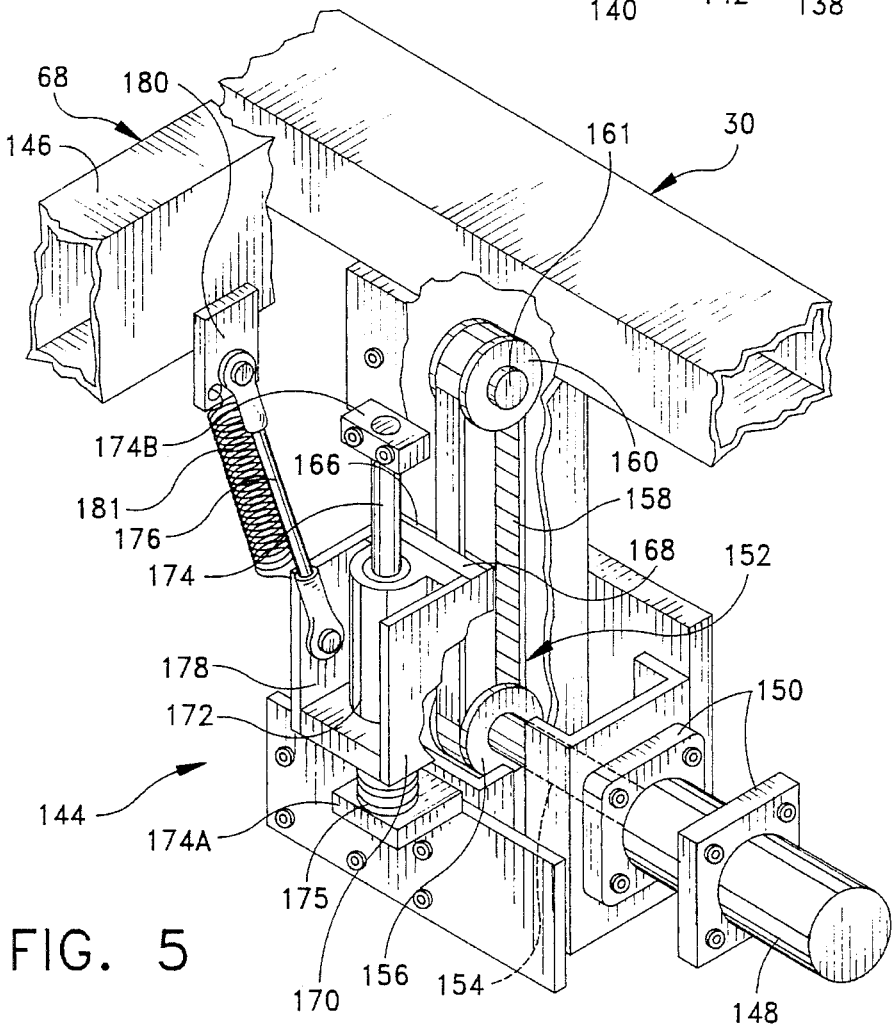
FIG. 5 is an enlarged fragmentary perspective view of a z axis drive of the apparatus for lifting an end of a shoe carriage frame of the shoe carriage.
Figure 5A:
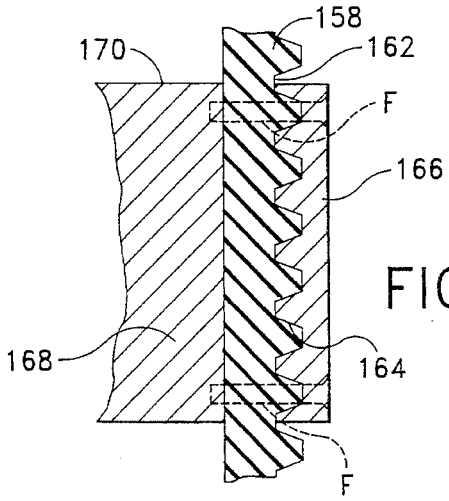
FIG. 5A is an enlarged cross-sectional detail view of the z axis drive.
Figure 6:
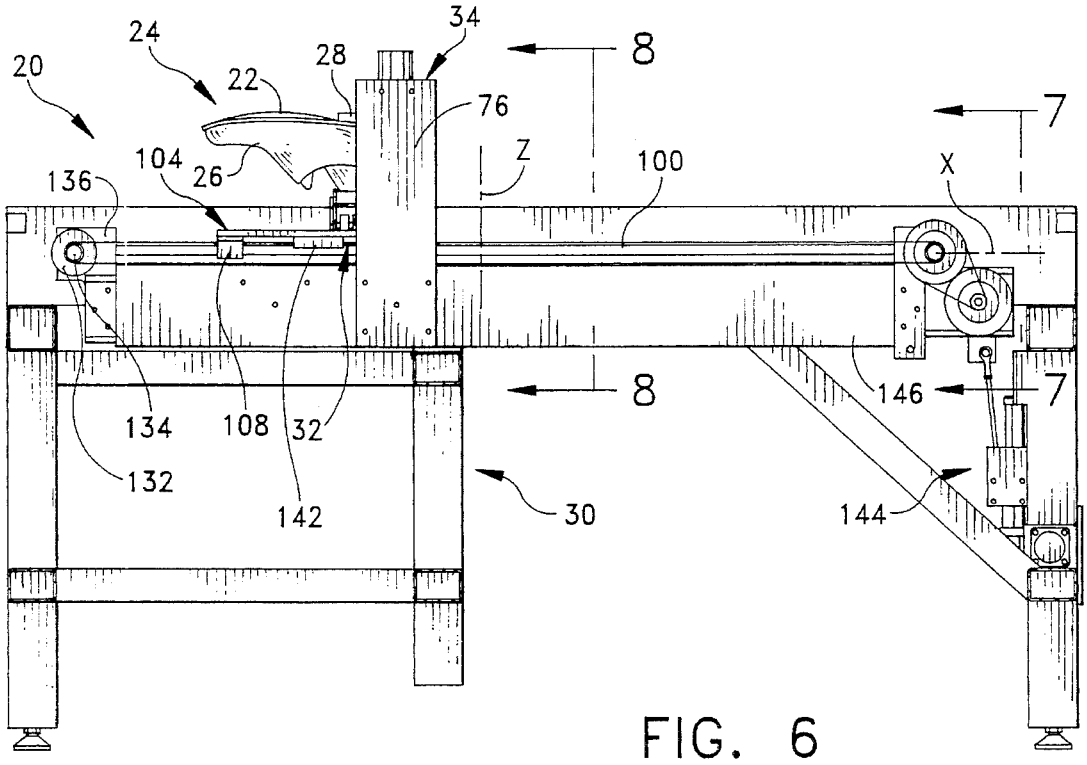
FIG. 6 is a partial side elevation view similar to FIGS. 3 and 4 with the shoe carriage entering a sensing station of the apparatus.

Still referring to FIGS. 3 and 4, and also to FIG. 5, the movement of the shoe carriage 32 along the z axis is controlled by a lifting device, generally indicated at 144 (otherwise sometimes referred to as the "z axis drive"). As mentioned above, the shoe carriage frame 68 is pivotable about axis 82. At end 146 of the shoe carriage frame 68, the lifting device 144 raises or lowers the end 146 of the frame 68 for controlling the up-and-down movement of the shoe carriage 32. Referring particularly to FIG. 5, the lifting device 144 comprises an electric servomotor 148 mounted on a pair of vertical supports 150 of the support structure 30, the servomotor 148 driving another pulley arrangement, generally indicated at 152. More particularly, the servomotor 148 rotates a shaft 154 having a first pulley 156 mounted on the opposite end of the shaft 154. The first pulley 156 of pulley assembly 152 drives a belt 158 which is looped around a second pulley 160 mounted on a shaft 161 above the first pulley 156 on the support structure 30. Referring to FIG. 5A, the belt 158 has grooves 162 formed therein which engage teeth (not shown) formed in the first and second pulleys 156, 160. The grooves 162 of belt 158 also engage teeth 164 formed in a bracket 166 mounted on a rear wall 168 of an enclosure 170 which houses a pillow block 172 therein. As shown, the pillow block 172 is adapted to move up-and-down on a shaft 174 which is suitably mounted by spaced bracket members 174A, 174B to the support structure 30. A spring 175 is provided at the lower end of the shaft 174 for dampening the impact force of the enclosure 170 when engaging the bracket 174A. The bracket 166 captures the belt 158 between the bracket 166 and the rear wall 168 of the enclosure 170. Suitable fasteners F secure the bracket 166 to the rear wall 168 of the enclosure 170. As with bracket 142, the teeth 164 of bracket 166 are formed on its surface facing the grooves 162 of the belt 158 for mating therewith and for enabling the enclosure 170 to move up-and-down along the shaft 174. Thus, by rotating the shaft 154 of the servomotor 148 clockwise or counterclockwise, the up-and-down movement of the pillow block 172 along the shaft 174 is controlled.

A rod 176 connects a side wall 178 of the enclosure 170 to a bracket 180 mounted on the shoe carriage support frame 68. The rod 176 moves up-and-down in response to the up-and-down movement of the enclosure 170 thereby moving the end 146 of the shoe carriage frame 68 up-and-down. A spring 181 is provided for tensioning the arrangement when moving the shoe carriage frame 68.

Figure 9:
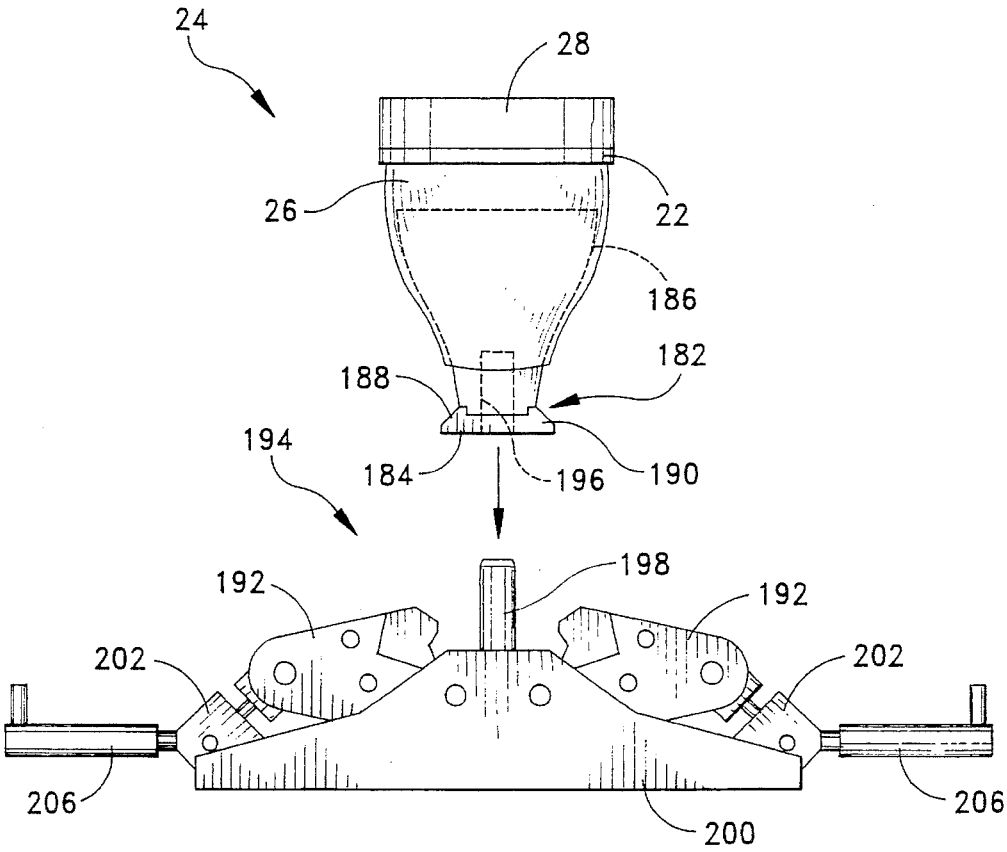
FIG. 9 is an enlarged fragmentary elevation view of a shoe last which receives a shoe and a clamping assembly for clamping the shoe last to the shoe carriage, the shoe last being spaced from the clamping assembly.
Figure 10:
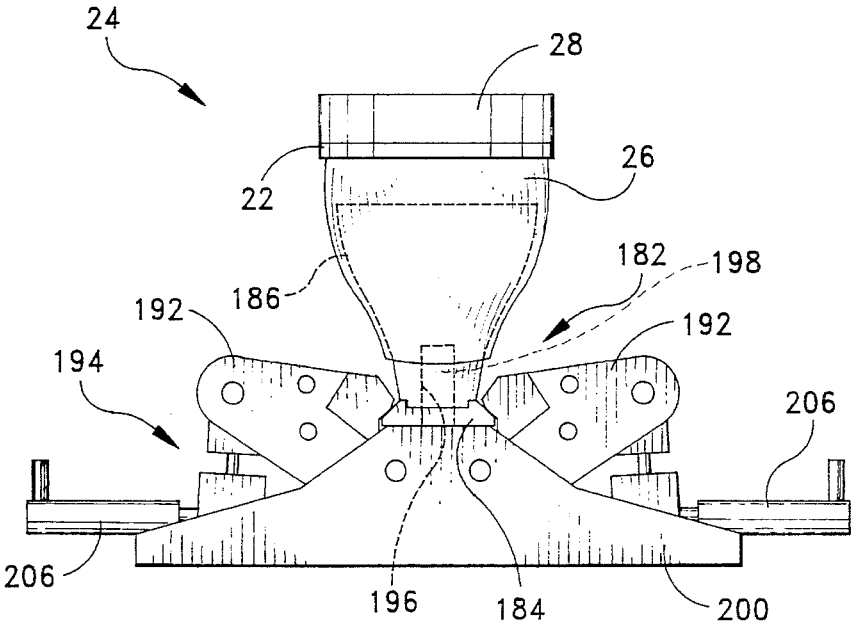
FIG. 10 is a view similar to FIG. 9 with the shoe last being clamped to the shoe carriage by the clamping assembly.

Referring now to FIGS. 8–10, the shoe 24 is mounted on a last, generally indicated at 182, which is constructed for receiving the shoe upper 26 in a position such that the sole 22 of the shoe 24 faces generally upwardly. The last 182 has a lower clamping plate 184 joined thereto and comprises an upwardly extending shoe upper insert portion 186 which is inserted into the shoe upper 26 for mounting the shoe 24 on the last 182. The clamping plate 184 includes opposite sides 188, 190 (FIG. 9) to which are engaged a pair of releasable clamps 192 of a clamping assembly, generally indicated at 194, which operates to clamp the clamping plate 184 to the platform 104 of the shoe carriage 32. The last 182 has a bore 196 formed therein which receives a guide pin 198 of the clamping assembly 194 for properly positioning the last 182 on the clamping assembly. The clamping assembly 194 includes a base 200 which is mounted (by bolts) on the plate 106 of the platform 104. Each releasable clamp 192 is attached to a linkage 202 which is connected to a pneumatically controlled air cylinder 204 (FIGS. 7 and 8) having a piston 206 (FIGS. 9 and 10) for moving the clamp 192 between an open position in which the clamp 192 is spaced from its respective side 188, 190 of the clamping plate 184 to a clamping position in which the clamp 192 engages its respective side 188, 190 of the clamping plate 184.

FIG. 9 illustrates the last 182 being spaced from the clamping assembly 194 with the clamps 192 in the open position and FIG. 10 illustrates the last 182 being positioned within the clamping assembly 194 with the clamps 192 in the clamping position. The clamping assembly 194 is designed so that the clamps 192, when engaging the sides 188, 190 of the clamping plate 184 of the last 182, prevent any movement of the last with respect to the shoe carriage 32. Any relative movement is also prohibited by the guide pin 198 which is inserted into the bore 196 formed in the last 182.

Figure 13:
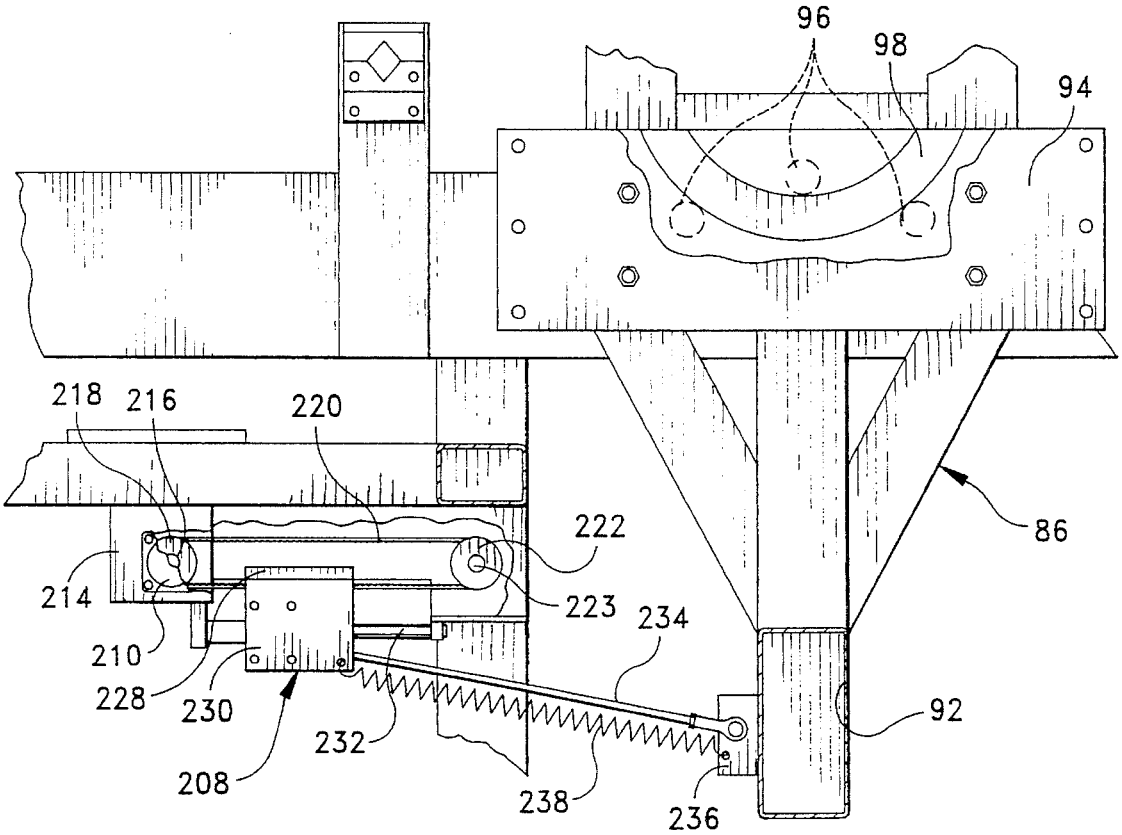
FIG. 13 is an enlarged fragmentary elevation view of a t axis drive of the apparatus for rotating the cutting station.
Figure 13A:
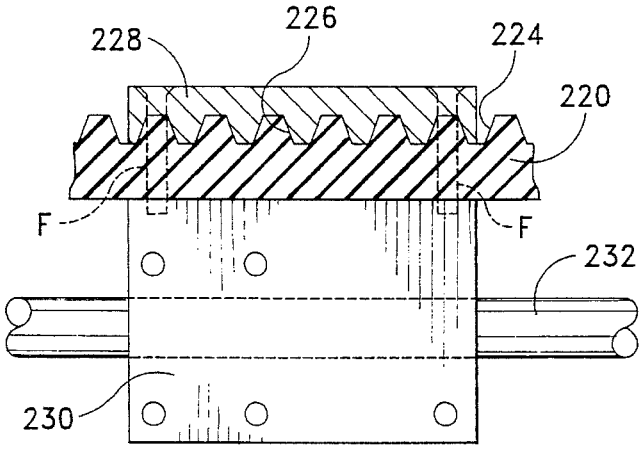
FIG. 13A is an enlarged cross-sectional detail view of the t axis drive.

Referring now to FIGS. 11–13, the cutter carriage frame 84 is rotatable about the t axis by a pulley arrangement, generally indicated at 208, which is driven by an electric servomotor 210 (otherwise sometimes referred to as the "t axis drive"). The construction and operation of the t axis drive is substantially identical to the construction and operation of the z axis drive. As discussed above, the cutter carriage frame 84 includes the yoke frame members 86 which are rotatably mounted on the support structure 30 in the manner described above. As shown in FIGS. 13 and 13A, the servomotor 210 is mounted on a vertical support 214 which is attached (as by welding) to the support structure 30. The servomotor 210 rotates a shaft 216 having a first pulley 218 mounted on the end of the shaft 216. The first pulley 218 drives a belt 220 which is looped around a second pulley 222 mounted to the right of the first pulley 218 on a shaft 223 supported by the support structure 30. The belt 220 has grooves 224 formed therein which engage teeth (not shown) formed in the first and second pulleys 218, 222. The grooves 224 of belt 220 also engage teeth 226 formed in a bracket 228 mounted on a top wall (not shown) of an enclosure 230 which houses a pillow block (not shown) therein. As shown, the enclosure 230 housing the pillow block is adapted to move side-to-side on a shaft 232 which is mounted by conventional brackets on the support structure 30. The bracket 228 captures the belt 220 between the bracket 228 and the top wall of the enclosure 230. Suitable fasteners F secure the bracket 228 to the top wall of the enclosure 230.

As with brackets 42, 166, the teeth 226 of bracket 228 are formed on its surface facing the grooves 224 of the belt 220 for mating therewith and for enabling the enclosure 230 to move side-to-side along the shaft 232 as the belt 220 moves.

A rod 234 connects a side wall (not shown) of the enclosure 230 to a bracket 236 mounted on the lower cross section 92 of the cutter carriage frame 84. The rod 234 moves side-to-side in response to the side-to-side movement of the enclosure 230 thereby rotating the yoke frame members 86 about the t axis. A spring 238 is provided for tensioning the arrangement when rotating the cutter carriage frame 84 about the t axis.

Figure 15:
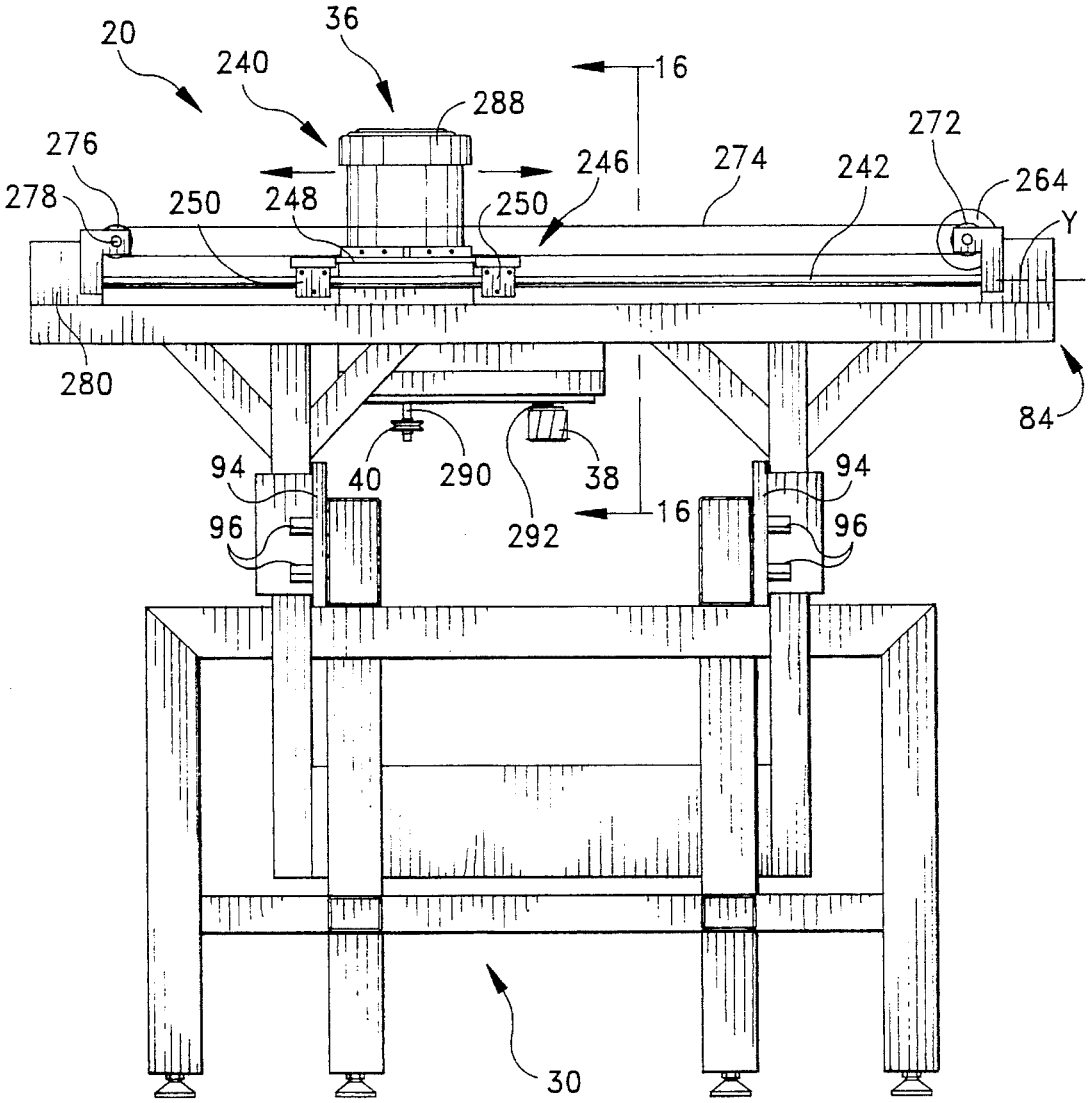
FIG. 15 is a view similar to FIG. 14 illustrating first and second cutters of the cutting station.
Figure 16:
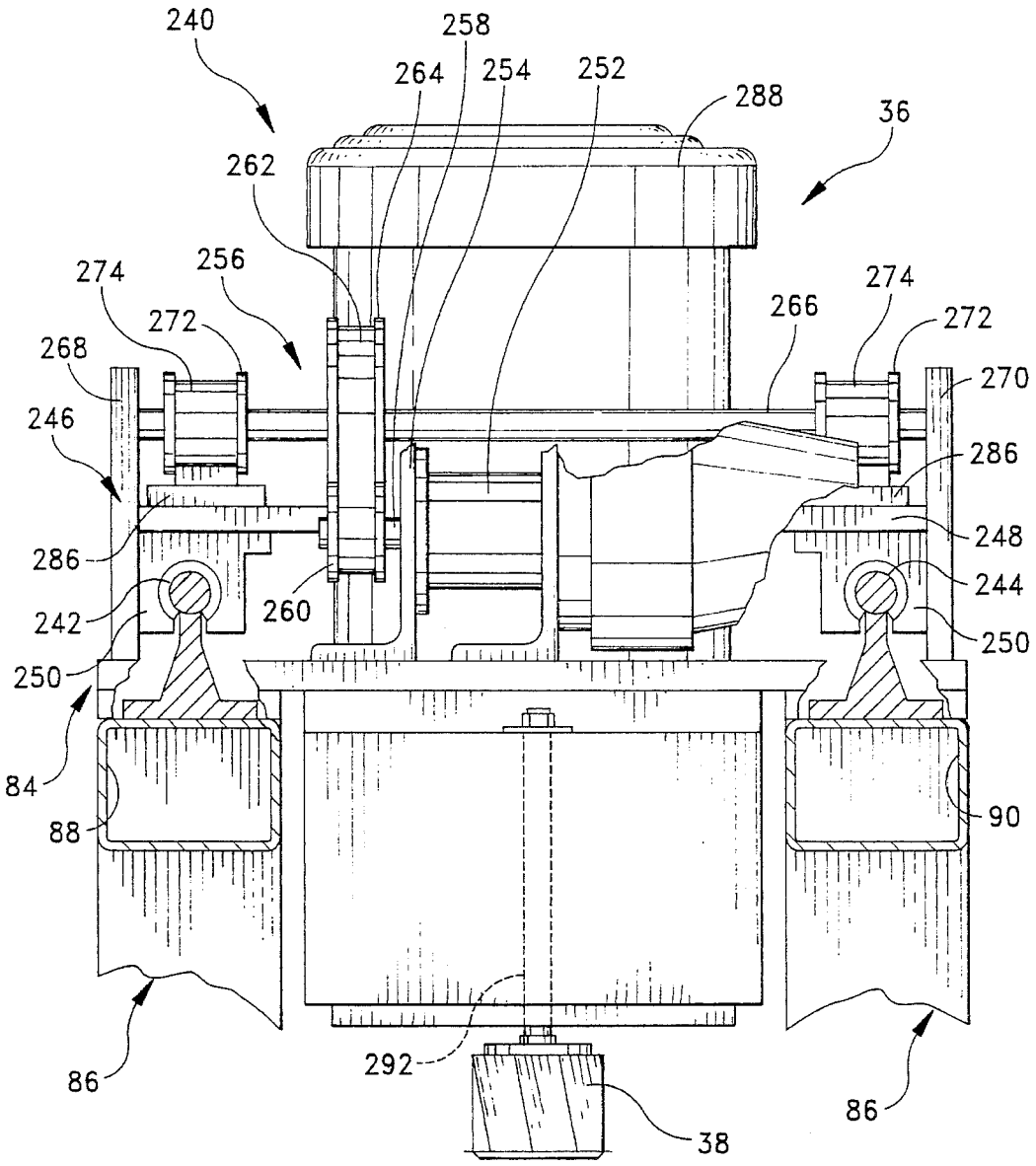
FIG. 16 is a cross section taken along line 16—16 of FIG. 15.

Turning to FIGS. 14–16, a cutter carriage, generally indicated at 240, is mounted on the cutter carriage frame 84. The cutter carriage 240 comprises a pair of rails 242, 244 mounted on the upper cross members 88, 90 of the cutter carriage frame 84, the rails 242, 244 extending in a transverse direction with respect to the rails 100, 102 of the shoe carriage 240. A platform, generally indicated 246, rides on the rails 242, 244 and is movable back and forth along the rails. The platform 246 includes a flat, rectangular plate 248 having four mounting blocks, each indicated 250, housing pillow blocks (not shown) therein which ride on the rails 242, 244 for guiding the back and forth movement of the platform 246 along the rails along the y axis. As shown, the mounting blocks 250 are located at the four corners of the plate 248 and are mounted on the plate by bolts.

Referring to FIG. 16, powering the back and forth movement of the cutter carriage platform along the rails 242, 244 (otherwise sometimes referred to as the "y axis drive") is an electric servomotor 252 mounted on an L-shaped bracket 254 of the cutter carriage frame 84 (see FIG. 16), the servomotor 252 driving a pulley arrangement, generally indicated at 256. The servomotor 252 rotates a shaft 258 having a first pulley 260 mounted thereon. The first pulley 260 drives a belt 262 which is looped around a second pulley 264 mounted above the first pulley 260 on a shaft 266 suitably mounted by bearings (not shown) on a pair of vertical supports 268, 270. The second pulley 264 in turn drives a pair of outer pulleys, each indicated at 272, mounted on opposite ends of the common shaft 266. The outer pulleys 272 drive a pair of belts, each indicated at 274, which extend along the length of the cutter carriage frame 84 and are looped around another pair of outer pulleys, each indicated at 276 (FIGS. 14 and 15), rotatable about a shaft 278 supported by pair of mounting blocks 280 which are located at the opposite end of the cutter carriage frame 84.

Figure 16A:
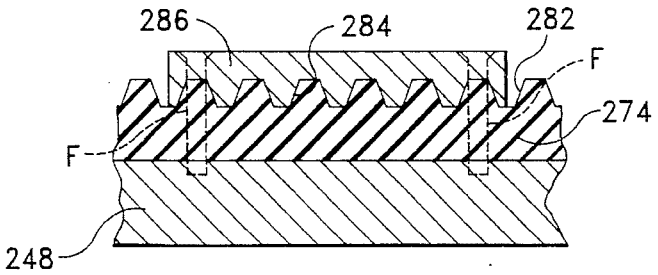
FIG. 16A is an enlarged cross-sectional detail view of a y axis drive of the apparatus.

Referring to FIG. 16A, each belt 274 has grooves 282 formed therein which engage teeth (not shown) formed in the pairs of outer pulleys 272, 276. The grooves 282 of each belt 274 also engage teeth 284 formed in brackets 286 mounted on the top surface of the plate 248 of the platform 246 which capture the belts 274 between the brackets 286 and the plate 248. Suitable fasteners F secure each bracket 286 to the top surface of the plate 248. Each bracket 286 has its teeth 284 formed on its surface which faces the grooves 282 of its respective belt 274 for mating therewith and for enabling the platform 246 to move longitudinally along the rails 242, 244 as the belt moves.

Still referring to FIGS. 14–16, a high-speed cutter motor 288 is mounted on the plate 248 of the platform 246 of the cutter carriage 240 for powering the rotation of the first cutter 38 and the second cutter 40. The motor 288 is suitably sized for rotating a shaft 290 at approximately 4,000 RPM. The first and second cutters 38, 40 extend below the platform 246, and as shown, the shaft 290 directly connects the second cutter 40 to the motor 288. A timing pulley (not shown) is mounted on the shaft 290 and drives a timing belt (not shown) which is looped around a timing pulley (not shown) provided on a first cutter shaft 292. The timing pulley of the first cutter shaft 292 is approximately 2.5 times smaller than the timing pulley of the second cutter shaft 290 for enabling the first cutter 38 to rotate at approximately 10,000 RPM. The first and second cutters 38, 40 are adapted to move along the y axis as the platform 246 moves from side-to-side and rotate about the t axis as the yoke frame members 86 of the cutter carriage frame 84 are rotated.

The first cutter 38 includes a plurality of sharp blades preferably fabricated from durable material such as carbon steel. As shown, the first cutter 38 is cylindrically-shaped for producing a relatively straight cut. The second cutter 40 is known in the art as a "rander" cutter and is preferably fabricated from carbide material. As shown, the second cutter 40 is shaped for bevelling the top and bottom edges of the sole 22. The second cutter 40 is capable of bevelling the edges of leather soles only.

Figure 18A:
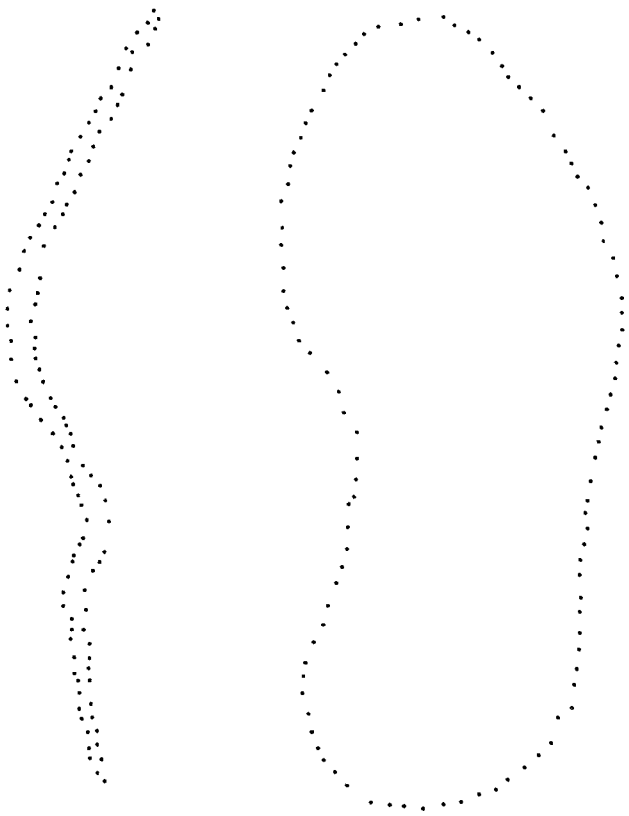
FIG. 18A is a view of the exact measured outline of the junction of the sole and the shoe upper.

Referring back to FIG. 8, the sensing station 34 comprises a detector (broadly "detecting means"), generally indicated at 294, for detecting the exact outline of the shoe upper 26 with respect to the sole 22. As illustrated, the detector 294 is supported by three horizontally disposed cross support members, each indicated at 296, which extend between the side plate members 76, 78 of the shoe carriage frame 68. The detector 294 comprises a pair fingers 298, 300 hingedly attached to respective linkages, generally designated 302, 304. When detecting the outline of the shoe upper 26 with respect to the sole 22, the fingers 298, 300 move along the periphery of the shoe 24 at the junction of the shoe upper 26 with the sole 22 such that one finger 298 moves along one side (i.e., the left side as viewed in FIG. 8) of the shoe 24 and the other finger 300 moves along the other side (i.e., the right) of the shoe. The x, y and z coordinates of the movement of the fingers 298, 300 and their respective linkages 302, 304 are transmitted to the microprocessor 42 for establishing the exact outline (in three dimensions) of the shoe upper 26 with respect to the sole 22 (see FIG. 18A). An encoder 306 monitors the location of the fingers 298, 300 and linkages 302, 304 and pneumatically driven cylinders (not shown) control their operation.

Figure 18B:
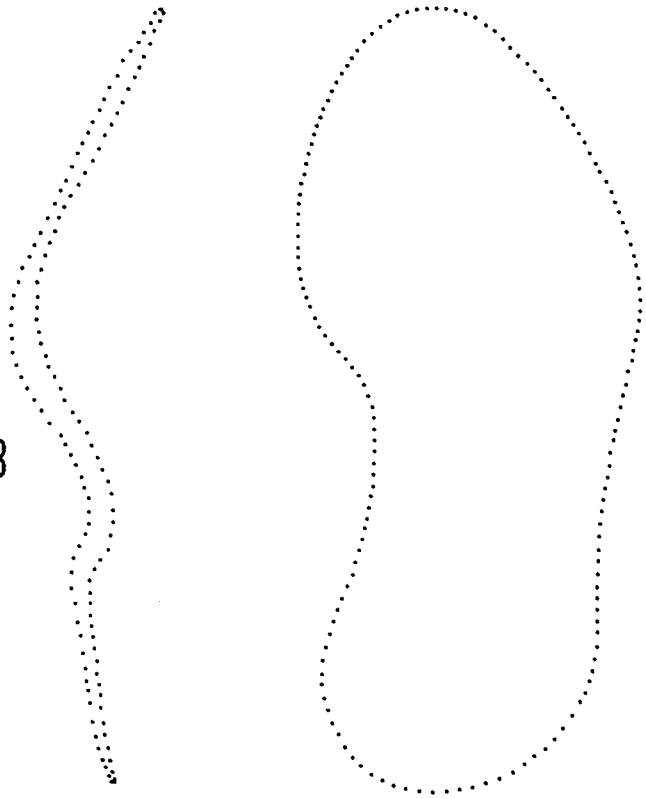
FIG. 18B is a view of the exact outline illustrated in FIG. 18A with the outline being smoothed by the microprocessor.
Figure 18C:
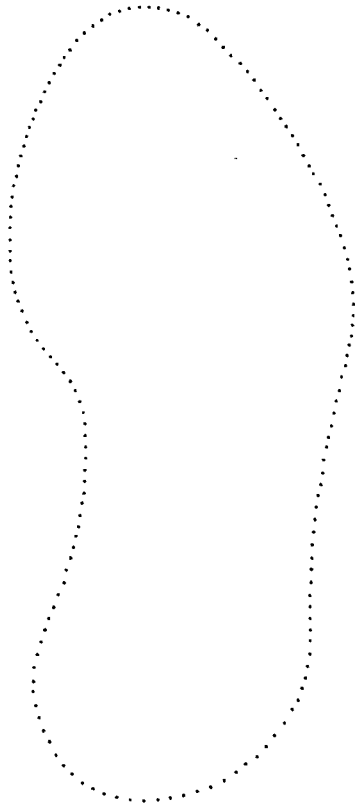
FIG. 18C is a view illustrating the average shape of typical shoes with the same style, width and size as the outline illustrated in FIG. 18B.
Figure 18D:
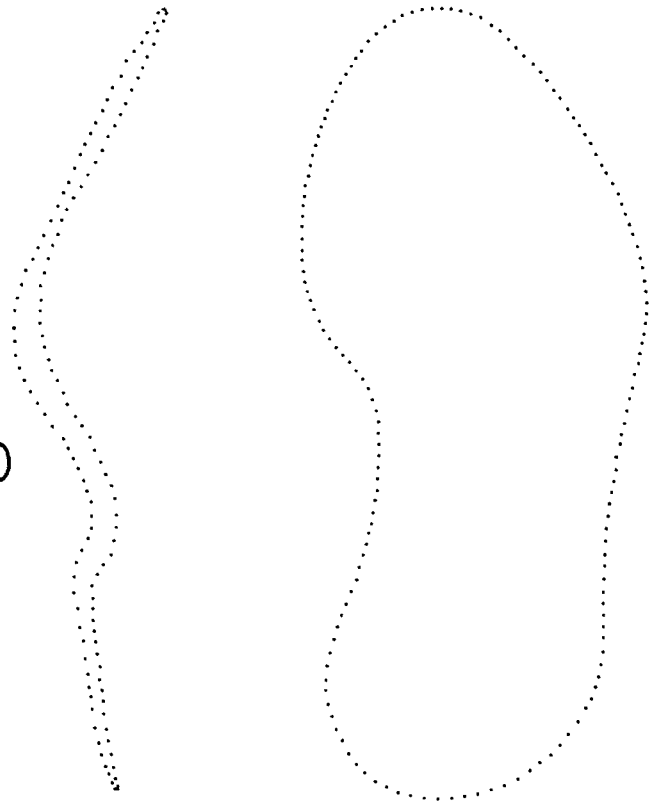
FIG. 18D is a view illustrating a trimming sole pattern for the shoe measured in FIG. 18A along which the sole is to be trimmed.

Once the microprocessor 42 establishes the exact outline of the shoe upper 26 with respect to the sole 22, it functions to smooth the curvature of the exact outline as illustrated in FIG. 18B. The microprocessor 42 then compares this smoothed outline to a variety of typical sole patterns (FIG. 18C) which are stored in the microprocessor's memory and selects a trimming pattern (FIG. 18D) which corresponds to the typical sole pattern most closely resembles the smooth outline typical sole pattern. It is this trimming pattern that the first and second cutters 38, 40 follow when trimming the sole 22 of the shoe 24. As shown in FIG. 18D, the microprocessor 42 is capable of controlling the four way movement of the apparatus 20 so that the cutters 28, 40 trim the sole 22 in three dimensions. More particularly, the microprocessor 42 controls the movement of the shoe carriage 32 along the shoe carriage frame 68 (i.e., along the x axis), the movement of the cutter carriage 240 along the cutter carriage frame 84 (i.e., along the y axis), the up-and-down movement of the shoe carriage frame 68 (i.e., along the z axis), and the rotational movement of the cutter carriage frame 84 (i.e., along the t axis).

It is to be noted that protective guards for protecting the operator of the apparatus, and shields and flaps for preventing shavings of material removed from the sole from entering the x, y, z and t drives, have been removed for illustrative purposes.

Figure 17:
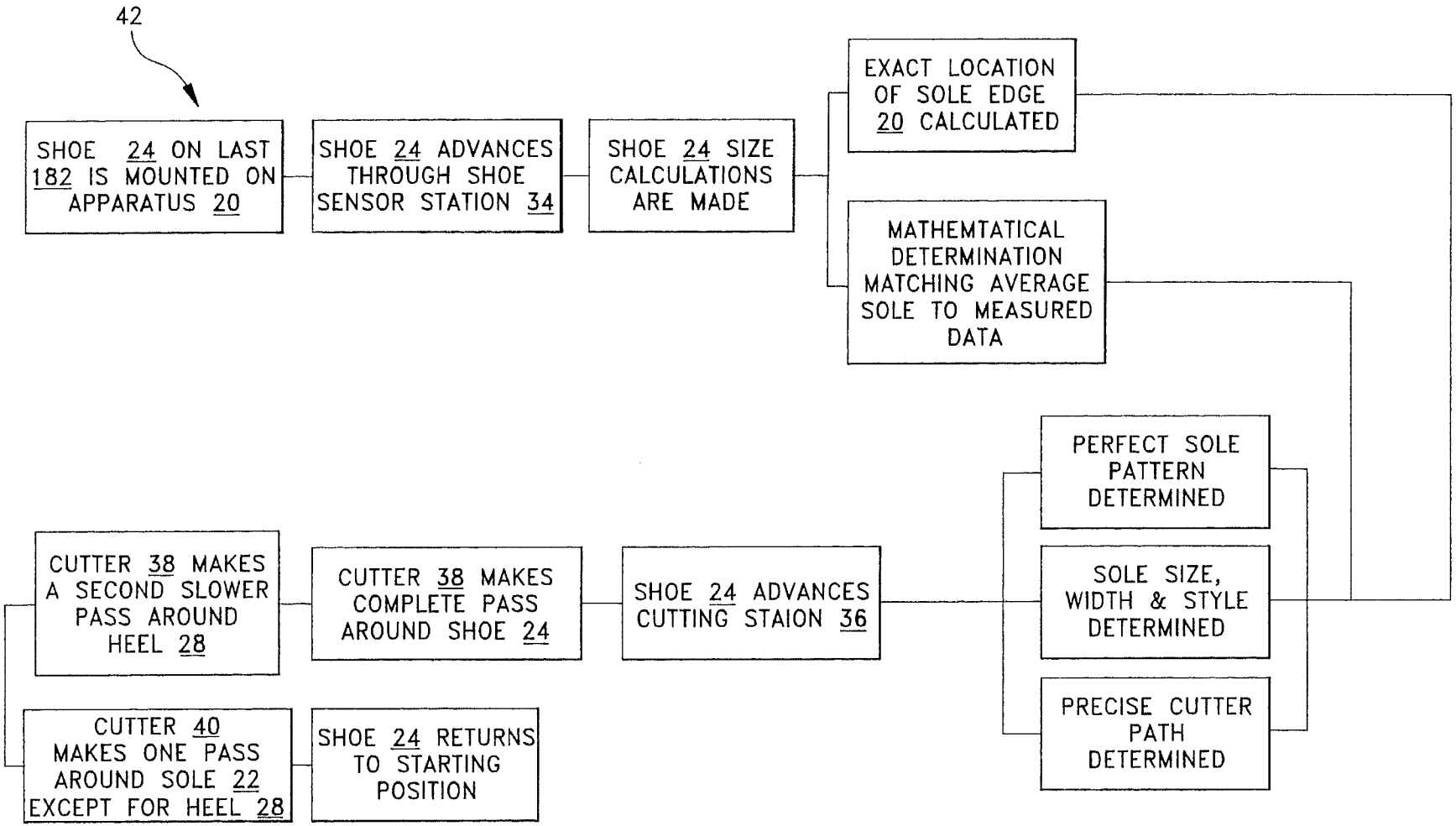
FIG. 17 is a flow chart illustrating the sequence of operation as controlled by a microprocessor of the apparatus.

Referring to FIG. 17, the operation of apparatus 20 is described as follows: Prior to trimming a sole 22 of a shoe 24, the microprocessor 42 performs a series of checking functions in order to properly set the various components of apparatus 20. These checking functions are typically performed at the start of the day when the apparatus 20 is powered for operation.

A shoe 24 requiring its sole 22 to be trimmed is mounted on the shoe last 182 in a manner such that the insert portion 186 of the shoe last 182 is inserted into the shoe upper 26 of the shoe 24. The clamping plate 184 of the shoe last 182 is placed on the clamping assembly 194 of the shoe carriage 32 and secured thereto by moving the releasable clamps 192 into the clamping position. As with all the steps of the operation, the microprocessor 42 controls the movement of the clamps 192. As illustrated in the drawings, the sole 22 of the shoe 24 faces upwardly. FIG. 3 illustrates the shoe 24 and shoe carriage 32 in a starting position.

The shoe carriage 32 is next moved along the x axis to the sensing station 34 where the exact outline of the shoe upper 26 with respect to the sole 22 is detected. More particularly, upon reaching the sensing station 34, the fingers 298, 300 of the detector 294 move along the periphery of the shoe 24 at the junction of the shoe upper 26 with the sole 22. The exact outline (in three dimensions) of the junction of the shoe upper 26 with the sole 22 is transmitted to the microprocessor 42 where it smooths the curvature of the exact outline for determining a sole pattern. The microprocessor 42 then compares the smoothed outline to a variety of typical sole patterns which are stored in the microprocessor's memory and selects a trimming pattern which most closely resembles the typical sole pattern. This step of the process takes approximately three seconds to complete.

Upon selecting the trimming pattern, the shoe carriage 32 moves directly to the cutting station 36 without having to move back to the starting position. Once at the cutting station 36, the first cutter 38 moves into position and makes one complete pass around the entire sole 22, trimming the sole 22 of the shoe 24 so that it matches the trimming pattern. This step of the procedure rough cuts the edge of the heel 28. As stated above, the first cutter 38 is rotating at approximately 10,000 RPM and the microprocessor 42 controls the movement of the cutter carriage 240 (along the y axis and about the t axis) and the movement of the shoe carriage 32 (along the x axis and the z axis) at a tolerance of approximately 0.002 inch. Thus, the apparatus 20 of the present invention is extremely accurate. The capability of the apparatus 20 to rotate the cutter carriage 240 about the t axis enables the first cutter 38 to properly trim the front of the shoe 24 where it curves slightly upwardly (downwardly when the shoe 24 is mounted on the last 182). This step of the process takes approximately fifteen seconds to complete.

After making one complete pass around the sole 22 of the shoe 24 (i.e., its rough cut), the first cutter 38 makes another, slower pass around a portion of the sole 22 adjacent the heel 28. This pass follows the same path as the first pass and is provided for removing any burrs or deformities present on the edge of the sole at the heel after the first pass (e.g., as a finer cut). This step of the process takes approximately five seconds to complete.

Next, for leather soles, the second cutter 40 is positioned to make a pass around the portion of the sole 22 which excludes the heel 28. As discussed above, the second cutter 40 is shaped for bevelling the top and bottom edges of the sole 22 along the sole trimming pattern. As with the first cutter 38, the second cutter 40 is also movable along the y axis and rotatable about the t axis, and the shoe carriage 32 moves the shoe along the x and z axes. Once the second cutter 40 makes a pass around the portion of the sole 22 excluding the heel 28, the shoe carriage 32 moves back to its starting position. This step of the process takes approximately seven seconds to complete.

Once back to the starting position, the clamps 192 of the clamping 194 assembly are moved to their open position and the shoe last 182 is removed from the shoe carriage 32. The last 182 is then removed from the shoe 24 and a new shoe, requiring trimming of its sole, is inserted onto the last 182 and clamped onto the apparatus 20 for trimming.

It should be observed that the apparatus 20 is especially suited for achieving the aforementioned objectives of the present invention in that it trims the sole of a shoe to a near perfect outline for the particular size of the shoe in a time efficient manner (approximately thirty seconds). Under normal operating conditions, the apparatus 20 requires only one worker to operate the apparatus which is but one station of a shoe manufacturing production line. The worker mounts the shoes on and off the apparatus and controls the operation of the apparatus 20. Thus, the shoe production line does not require additional workers to manually trim the soles of shoes in order to maintain the flow of shoes produced by the particular production line. Also, workers will no longer have to perform the dangerous task of manually manipulating shoes adjacent high-speed cutters.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as ,indicated by the scope of the appended claims.

What is claimed is:

1. An apparatus for trimming a sole of a shoe having a shoe upper, said sole being attached to the shoe upper, said apparatus having members that are movable in at least three directions of movement along an x axis, a y axis and a z axis, said apparatus comprising:

a support structure;

a shoe carriage mounted on said support structure, said shoe carriage being constructed and arranged for mounting a shoe thereon and being movable back and forth along the x axis and up-and-down along the z axis;

a sensing station mounted on said support structure, said sensing station comprising means for detecting the exact outline of the shoe upper with respect to the sole;

a cutting station mounted on said support structure for trimming the sole of the shoe with a first cutter, the first cutter being movable side-to-side along the y axis; and means for controlling the movement of the carriage between a starting position, the sensing station, the cutting station and back to the starting position and for controlling the operation and movement of the first cutter for trimming the sole of the shoe when the shoe is in the cutting station in accordance with the information as detected at the sensing station.

2. The apparatus as set forth in claim 1, said shoe carriage comprising a pair of rails and a platform which rides on the rails.

3. The apparatus as set forth in claim 2, said platform of the shoe carriage comprising a plate and mounting blocks mounted on the underside of the plate, said mounting blocks riding on said rails for guiding the back and forth movement along the x axis of the plate along the rails.

4. The apparatus as set forth in claim 3, said shoe carriage further comprising a motor, controlled by said control means, which drives a pulley arrangement for powering the movement of the platform along the rails.

5. The apparatus as set forth in claim 2, said shoe carriage being pivotally attached to the support structure adjacent one of its ends for enabling the up-and-down movement along the z axis of the shoe mounted on said shoe carriage with respect to said cutting station.

6. The apparatus as set forth in claim 5 further comprising a shoe carriage frame mounted on said support structure, said shoe carriage frame supporting said shoe carriage and being pivotally connected adjacent one of its ends to said support structure and supported at its other end by a lifting device.

7. The apparatus as set forth in claim 6, said lifting device comprising a pulley arrangement driven by a motor, said pulley arrangement effecting the up-and-down movement of said shoe carriage frame thereby enabling said up-and-down movement of the shoe with respect to the cutting station.

8. The apparatus as set forth in claim 2, said first cutter extending below the platform, and comprising rotatable blades driven by a motor mounted on said platform.

9. The apparatus as set forth in claim 1 further comprising a last constructed and arranged for receiving the shoe upper of the shoe in a position such that the sole of the shoe faces generally upwardly, said last being mounted on the shoe carriage.

10. The apparatus as set forth in claim 9, said last comprising a clamping plate and an upwardly extending shoe upper insert portion which is inserted into the shoe upper for attaching the shoe to the last.

11. The apparatus as set forth in claim 10, said shoe carriage comprising a clamping assembly for clamping the clamping plate to the carriage, said clamping assembly having a pair of releasable clamps for clamping opposing sides of the clamping plate.

12. The apparatus as set forth in claim 11, said clamping assembly further including, for each clamp, a pneumatically controlled piston for moving the clamp between a position in which the clamp is spaced from its respective side of the clamping plate to a position in which the clamp engages its respective side of the clamping plate.

13. The apparatus as set forth in claim 1, said cutting station comprising a second cutter mounted on said cutting station for bevelling edges of the sole of the shoe, said second cutter being movable along the y axis.

14. The apparatus as set forth in claim 13, the second cutter comprising a carbide cutting blade.

15. The apparatus as set forth in claim 13, said control means controlling the movement and operation of the second cutter.

16. The apparatus as set forth in claim 1, said cutting station comprising a cutter carriage extending transversely with respect to the shoe carriage, said cutter carriage supporting said first cutter.

17. The apparatus as set forth in claim 16, said cutter carriage comprising a pair of rails and a platform which rides on the rails.

18. The apparatus as set forth in claim 17, said platform of the cutter carriage comprising a plate and mounting blocks mounted on the underside of the plate, said mounting blocks riding on said rails for guiding the side-to-side movement along the y axis of the plate along the rails.

19. The apparatus as set forth in claim 18, said cutter carriage further comprising a motor, controlled by said control means, which drives a pulley arrangement for powering the movement of the cutter carriage platform along the rails.

20. The apparatus as set forth in claim 17, said cutter carriage being rotatable about a t axis which extends in a direction parallel to the rails of the cutter carriage for enabling the rotational movement of the first cutter.

21. The apparatus as set forth in claim 20 further comprising a cutter carriage frame having a pair of spaced apart yoke frame members rotatably mounted on the support structure about the t axis, said yoke frame members being connected by cross members, said yoke frame members being rotatably movable by a movable bar pivotally connected to the cutter carriage frame at one end thereof and attached to the support structure at its other end.

22. The apparatus as set forth in claim 21, said bar being movable by a pulley arrangement driven by a motor mounted on said support structure.

23. The apparatus as set forth in claim 1, said control means comprising a microprocessor, said microprocessor, upon receiving the exact outline as detected by said detector means, smooths the curvature of the exact outline.

24. The apparatus as set forth in claim 23, said microprocessor comparing the smooth outline to a variety of typical sole patterns stored in the microprocessor's memory and selecting a trimming pattern which most closely resembles the typical sole pattern for the particular shoe whereby said first cutter trims the sole in accordance with the predetermined trimming pattern.

25. The apparatus as set forth in claim 23, said detector means comprising a pair of fingers hingedly attached to respective linkages which are mounted on the support structure, said fingers moving along the periphery of the shoe at the junction of the shoe upper with the sole such that one finger moves along one side of the shoe and the other finger moves along the other side of the shoe, said fingers being adapted to locate said exact outline of the shoe upper with respect to the sole and to transmit to the microprocessor the exact outline thereof.

26. A process for trimming a sole of a shoe having a shoe upper, said sole being attached to the shoe upper, said process comprising the steps of:

(a) mounting a shoe on a shoe carriage of an apparatus having members that are movable in at least three directions along an x axis, a y axis and a z axis, said shoe carriage being in a starting position and movable back and forth along the x axis and up-and-down along the z axis;

(b) moving the shoe carriage along the x axis to a sensing station;

(c) detecting the exact outline of the shoe upper with respect to the sole;

(d) determining a sole trimming pattern based on the outline of the shoe upper with respect to the sole as detected by the sensing station;

(e) moving the shoe carriage along the x axis to a cutting station for trimming the sole of the shoe with a first cutter along said sole trimming pattern, the first cutter being movable from side-to-side along the y axis and said shoe carriage being movable along the x and z axes for trimming the sole of the shoe; and (f) moving the shoe carriage back to its starting position.

27. The process as set forth in claim 26 further comprising the step of mounting the shoe upper of the shoe on a last in a position such that the sole faces generally upwardly.

28. The process as set forth in claim 27 further comprising the step of clamping the last to a clamping assembly of the shoe carriage.

29. The process as set forth in claim 26, before the step of moving the shoe carriage back to its starting position, further comprising the step of bevelling edges of the sole along the sole trimming pattern with a second cutter, the second cutter being movable along the y axis and rotatable about the t axis.

30. The process as set forth in claim 26 further comprising the step of smoothing the curvature of the exact outline as detected by the sensing station.

31. The process as set forth in claim 30, said step of determining a sole trimming pattern comprising the steps of comparing the smoothed outline to a variety of typical sole patterns stored in the microprocessor's memory and selecting a trimming pattern which most closely resembles the typical sole pattern for the particular shoe smoothed outline whereby said first cutter trims the sole along the trimming pattern.

32. The process as set forth in claim 26 comprising the further step of rotating said first cutter about a t axis.

* * * * *